US005559392A

United States Patent [19]

Cocoma et al.

[11] Patent Number: 5,559,392

[45] Date of Patent: Sep. 24, 1996

[54] APPARATUS FOR SECURING AN AMALGAM AT THE APEX OF AN ELECTRODELESS FLUORESCENT LAMP

[75] Inventors: John P. Cocoma, Clifton Park; Joseph C. Boroweic; Ronald H. Wilson, both of Schenectady, all of N.Y.

[73] Assignee: General Electric Company, Schenectady, N.Y.

[21] Appl. No.: 258,879

[22] Filed: Jun. 13, 1994

[51] Int. Cl.[6] ..... H01J 61/28; H05B 41/00

[52] U.S. Cl. ..... 313/490; 313/550; 313/564; 315/267; 315/344

[58] Field of Search ..... 313/490, 564, 313/565, 550, 552; 315/248, 344, 267

[56] References Cited

U.S. PATENT DOCUMENTS 2,532,463 12/1950 Samer ..... 313/565
4,262,231 4/1981 Anderson et al. .
4,437,041 3/1984 Roberts .
4,622,495 11/1986 Smeelen .
4,728,867 3/1988 Postma et al. .

*Primary Examiner*—Michael Tokar
*Assistant Examiner*—Matthew J. Esserman
*Attorney, Agent, or Firm*—Jill M. Breedlove; Marvin Snyder

[57] ABSTRACT

A first portion of a spiral wire support for an amalgam is securely fitted into an exhaust tube formed in a re-entrant cavity of an electrodeless fluorescent lamp before attachment and sealing of the re-entrant cavity to the bulb of the lamp. A second portion of the spiral wire support extends into the bulb and holds an amalgam in thermal contact with the apex of the bulb. The second portion has a larger diameter than the first portion to ensure against movement of the spiral wire support into the exhaust tube. The end of the second portion of the spiral wire support is wetted with an alloy capable of forming an amalgam with mercury prior to insertion of the wire support into the exhaust tube. Mercury is added to the bulb after final evacuation of the bulb in preparation for dosing the lamp with its fill. As a result, an amalgam is formed and maintained in thermal contact with the apex of the bulb, regardless of lamp orientation.

3 Claims, 2 Drawing Sheets

APPARATUS FOR SECURING AN AMALGAM AT THE APEX OF AN ELECTRODELESS FLUORESCENT LAMP

FIELD OF THE INVENTION

The present invention relates generally to electrodeless fluorescent lamps and, more particularly, to placement and support of an amalgam in such a lamp for optimally controlling mercury vapor pressure therein.

BACKGROUND OF THE INVENTION

The optimum mercury vapor pressure for production of 2537Å radiation to excite a phosphor coating in a fluorescent lamp is approximately six millitorr, corresponding to a mercury reservoir temperature of approximately 40° C. Conventional tubular fluorescent lamps operate at a power density (typically measured as power input per phosphor area) and in a fixture configuration to ensure operation of the lamp at or about a mercury vapor pressure of six millitorr (typically in a range from approximately four to seven millitorr); that is, the lamp and fixture are designed such that the coolest location, i.e., cold spot, in the fluorescent lamp is approximately 40° C. Compact fluorescent lamps, however, including electrodeless solenoidal electric field (SEF) fluorescent discharge lamps, operate at higher power densities with the cold spot temperature typically exceeding 50° C. As a result, the mercury vapor pressure is higher than the optimum four to seven millitorr range, and the luminous output of the lamp is decreased.

One approach to controlling the mercury vapor pressure in an SEF lamp is to use an alloy capable of absorbing mercury from its gaseous phase in varying amounts, depending upon temperature. Alloys capable of forming amalgams with mercury have been found to be particularly useful. The mercury vapor pressure of such an amalgam at a given temperature is lower than the mercury vapor pressure of pure liquid mercury.

Unfortunately, positioning an amalgam to achieve a mercury vapor pressure in the optimum range in an SEF lamp is difficult. For stable long-term operation, the amalgam should be placed and retained in a relatively cool location with minimal temperature variation. Such an optimal location is at or near the tip, or apex, of the bulb of the lamp.

Accordingly, it is desirable to provide a relatively simple method and apparatus for introducing and securing an amalgam at or near the apex of the bulb of an electrodeless SEF fluorescent discharge lamp. A practical amalgam support should maintain the optimal location of the amalgam, regardless of lamp orientation.

SUMMARY OF THE INVENTION

A first portion of a spiral wire support for an amalgam is securely fitted into an exhaust tube formed in a re-entrant cavity of an electrodeless fluorescent lamp before attachment and sealing of the re-entrant cavity to the outer envelope, or bulb, of the lamp. A second portion of the spiral wire support extends into the bulb and holds an amalgam in thermal contact with the apex of the bulb. Preferably, the second portion has a larger diameter than the first portion to ensure against movement of the spiral wire support into the exhaust tube. The end of the second portion of the spiral wire support is wetted with an alloy capable of forming an amalgam with mercury prior to insertion of the wire support into the exhaust tube. Mercury is added to the bulb after final evacuation of the bulb in preparation for dosing the lamp with its fill. As a result, an amalgam is formed and maintained in thermal contact with the apex of the bulb, regardless of lamp orientation.

BRIEF DESCRIPTION OF THE DRAWINGS

The features and advantages of the present invention will become apparent from the following detailed description of the invention when read with the accompanying drawings in which.

DETAILED DESCRIPTION OF THE INVENTION

Figure 1:
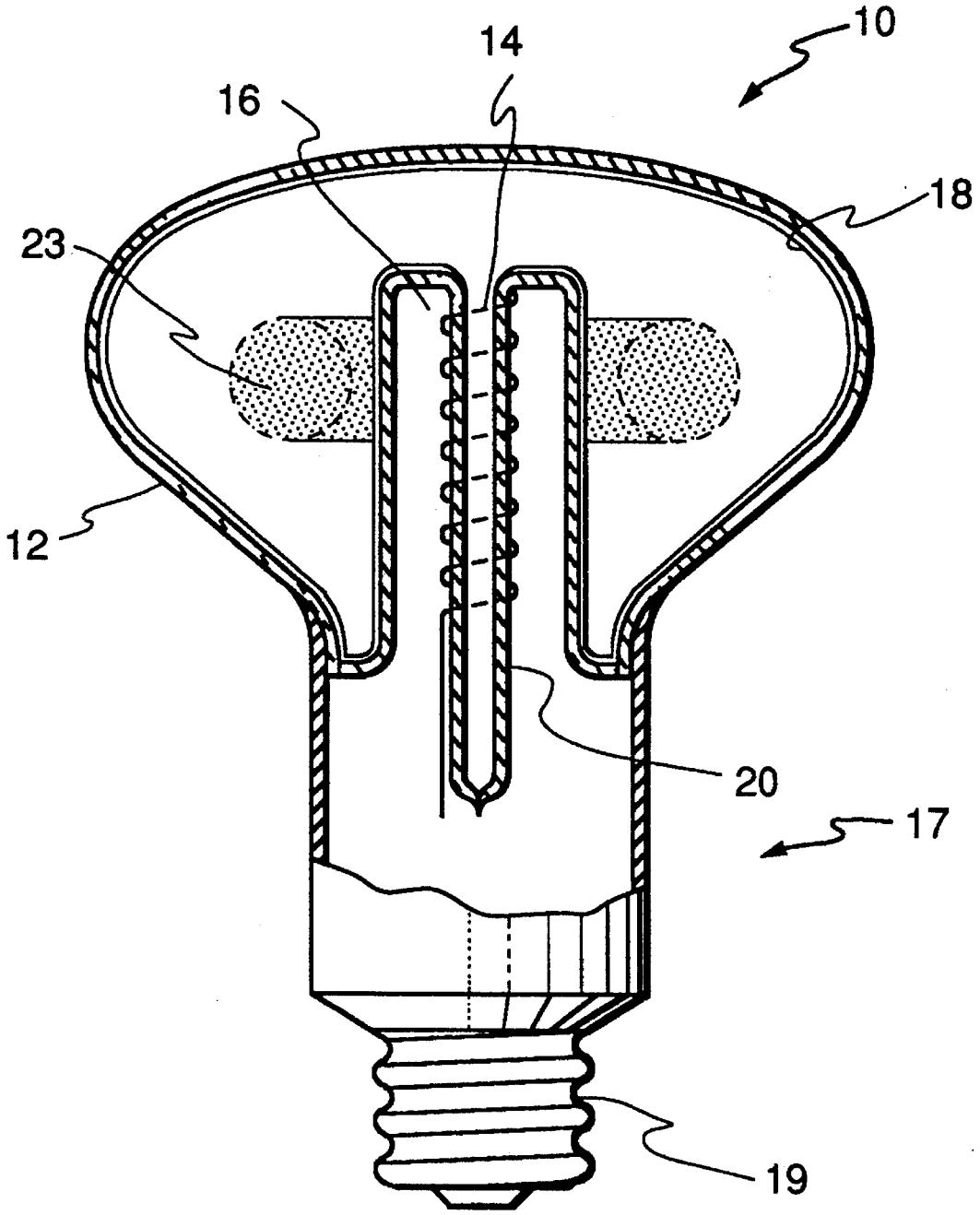
FIG. 1 ( PRIOR ART)
FIG. 1 illustrates, in partial cross section, a typical electrodeless SEF fluorescent lamp.

FIG. 1 illustrates a typical electrodeless SEF fluorescent discharge lamp 10 having an envelope, or bulb, 12 containing an ionizable gaseous fill. A suitable fill, for example, comprises a mixture of a rare gas (e.g., krypton and/or argon) and mercury vapor and/or cadmium vapor. An excitation coil 14 is situated within, and removable from, a re-entrant cavity 16 within bulb 12. For purposes of illustration, coil 14 is shown schematically as being wound about an exhaust tube 20 which is used for filling the lamp. However, the coil may be spaced apart from the exhaust tube and wound about a core of insulating material or may be free standing, as desired. The interior surfaces of bulb 12 are coated in well-known manner with a suitable phosphor 18. Bulb 12 fits into one end of a base assembly 17 containing a radio frequency power supply (not shown) with a standard (e.g., Edison type) lamp base 19 at the other end.

In operation, current flows in coil 14 as a result of excitation by a radio frequency power supply (not shown). As a result, a radio frequency magnetic field is established within bulb 12, in turn creating an electric field which ionizes and excites the gaseous fill contained therein, resulting in an ultraviolet-producing discharge 23. Phosphor 18 absorbs the ultraviolet radiation and emits visible radiation as a consequence thereof.

In accordance with the present invention, a properly constituted amalgam is accurately placed and retained in an optimal location in an SEF lamp for operation at a mercury vapor pressure in the optimum range from approximately four to seven millitorr, which amalgam maintains its composition and location during lamp operation, regardless of lamp orientation. In particular, the amalgam is accurately positioned and retained at a relatively cool location with minimal temperature variation substantially at the apex 24 of the lamp bulb. The apex of the bulb typically comprises the cold spot of the lamp.

An exemplary amalgam comprises a combination of bismuth and indium. Another exemplary amalgam comprises pure indium. Still another exemplary amalgam comprises a combination of lead, bismuth and tin, such as described in commonly assigned U.S. Pat. No. 4,262,231, cited hereinabove. And yet another amalgam may comprise a combination of zinc, indium and tin. Each amalgam has its own optimum range of operating temperatures.

Figure 2:
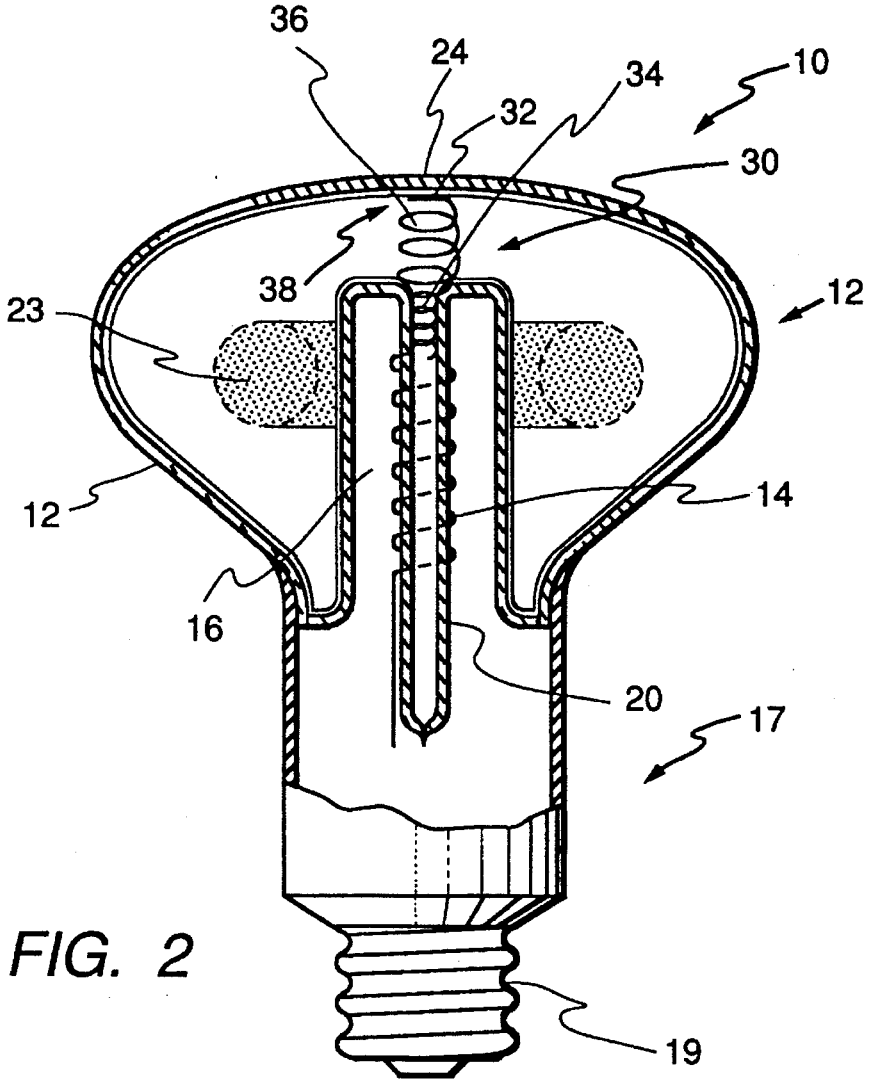
FIG. 2 illustrates an an electrodeless SEF lamp including an amalgam positioned therein according to the present invention.

FIG. 2 illustrates one embodiment of an amalgam support 30 for maintaining an amalgam 32 in an optimal position in thermal contact with the apex 24 of bulb 12 according to the present invention. Amalgam support 30 comprises a spiral wire having a first portion 34 securely fitted into exhaust tube 20. A second portion 36 has an end 38 for maintaining the amalgam in thermal contact with the apex of the bulb, regardless of lamp orientation. Second portion 36 of the spiral wire support preferably has a larger diameter than first portion 34 in order to ensure against movement of the spiral wire support into the exhaust tube. A suitable spiral wire support may comprise nickel or steel, for example.

Figure 3:
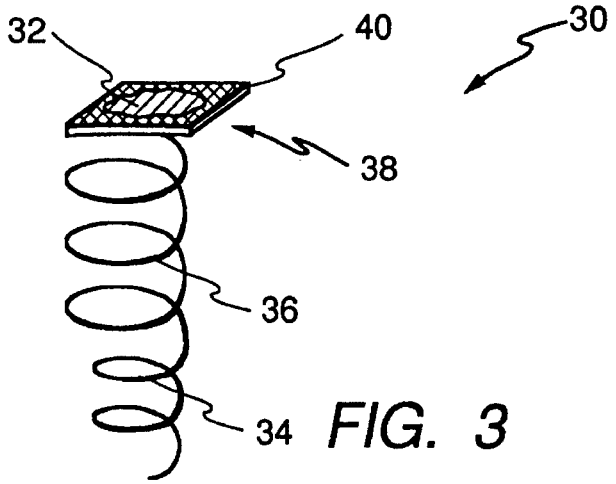
FIG. 3 is a perspective view illustrating an alternative embodiment of an amalgam support according to the present invention.

In an alternative embodiment, as illustrated in FIG. 3, a wire mesh 40 may be attached to the end 38 for supporting amalgam 32 in contact with apex 24 of bulb 12.

During lamp processing, in typical manner, re-entrant cavity 16 with exhaust tube 20 formed therein is separately formed from bulb 12. In accordance with the present invention, however, the end 38 of spiral wire support 30 is wetted with an alloy capable of forming an amalgam with mercury (e.g., indium) and is fitted within exhaust tube 20 before attaching and sealing re-entrant cavity 16 to bulb 12. Later, after the lamp has been evacuated via a pumping line (not shown) through exhaust tube 20 in preparation for dosing the lamp with its fill in well-known manner, mercury is added. As a result, an amalgam is formed on the end 38 of spiral wire support 30.

In one embodiment, mercury is added as a liquid. In another embodiment, mercury is added in solid form, for example as a mercury-zinc pellet such as of a type provided by APL Engineered Materials, Inc. When heated, the mercury liquifies and separates from the zinc to form the amalgam at the end 38 of the spiral wire support.

Advantageously, spiral wire support 30 maintains the amalgam in thermal contact with the apex of the bulb, regardless of lamp orientation. In addition, the spiral wire support acts to restrict the spread of the amalgam when in a liquid state.

Furthermore, spiral wire support 30 does not interfere with lamp processing or require any modification of the re-entrant cavity. And, since the spiral wire support is inserted early in lamp processing without mercury, there is no concern about vaporizing and losing mercury during high-temperature lamp processing steps.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A solenoidal electric field (SEF) fluorescent discharge lamp, comprising:

a light-transmissive bulb containing an ionizable, gaseous fill for sustaining an arc discharge when subjected to a radio frequency magnetic field and for emitting ultraviolet radiation as a result thereof, said bulb having an interior phosphor coating for emitting visible radiation when excited by said ultraviolet radiation, said bulb having an apex portion, said bulb further having a re-entrant cavity therein;

an excitation coil contained within said re-entrant cavity for providing said radio frequency magnetic field when excited by a radio frequency power supply;

an exhaust tube extending through said re-entrant cavity;

an amalgam support for supporting an amalgam within said bulb, said amalgam support comprising a spiral wire having a first portion fitted within said exhaust tube and a second portion extending within said bulb, said second portion having an end thereof for holding said amalgam in thermal contact with said apex portion of said bulb during lamp operation, said second portion of said spiral wire having a larger diameter than said first portion.

2. The lamp of claim 1 wherein said spiral wire comprises a metal selected from a group consisting of nickel and steel.

3. The lamp of claim 1 wherein said spiral wire further comprises a wire mesh attached to said end of said second portion.

* * * * *